US007115889B2

(12) United States Patent
Koker et al.

(10) Patent No.: US 7,115,889 B2
(45) Date of Patent: Oct. 3, 2006

(54) DEVICE AND METHOD FOR SENSING THE POSITION OF AN EDGE OF A PRODUCT

(75) Inventors: Torsten Koker, Mannheim (DE); Hans Butterfass, Heidelberg (DE); Wolfgang Dolz, Heidelberg (DE); Andeas Henn, Neckargemuend (DE); Tobias Mueller, Hirschberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 69 days.

(21) Appl. No.: 10/858,002

(22) Filed: Jun. 1, 2004

(65) Prior Publication Data

US 2005/0017205 A1 Jan. 27, 2005

(30) Foreign Application Priority Data

Jun. 5, 2003 (DE) ..... 103 25 377

(51) Int. Cl.
*G01N 21/86* (2006.01)
*G01N 21/88* (2006.01)
*G01V 8/00* (2006.01)

(52) U.S. Cl. ..... 250/559.36; 356/429; 356/637

(58) Field of Classification Search ..... 250/559.36, 250/559.09, 559.29, 225, 559.27; 356/71, 356/638, 613, 621, 637, 429; 271/258.01, 271/265.01

See application file for complete search history.

(56) References Cited

U.S. PATENT DOCUMENTS

| | | | | |
|---|---|---|---|---|
| 4,021,031 A | | 5/1977 | Meihofer et al. | 226/20 |
| 5,369,284 A | | 11/1994 | Bellio | 250/561 |
| 5,724,150 A | * | 3/1998 | Schaede et al. | 356/429 |
| 5,914,784 A | * | 6/1999 | Ausschnitt et al. | 356/624 |
| 6,264,196 B1 | | 7/2001 | Loetsch | 271/228 |
| 2001/0001576 A1 | * | 5/2001 | Haque et al. | 356/429 |
| 2002/0027208 A1 | * | 3/2002 | Haque et al. | 250/559.36 |

FOREIGN PATENT DOCUMENTS

| | | |
|---|---|---|
| DE | 3637874 | 5/1988 |
| DE | 3742527 | 6/1989 |
| DE | 4337707 | 5/1995 |
| DE | 19618030 | 11/1997 |

(Continued)

OTHER PUBLICATIONS

David X.D. Yang, Abbas El Gamal, Boyd Fowler, Hui Tian, A 640×512 CMOS Image Sensor with Ultrawide Dynamic Range Floating-Point Pixel-Level ADC, IEEE Journal of Solid-State Circuits, vol. 34, No. 12, Dec. 1999, pp. 1821-1834.

(Continued)

*Primary Examiner*—Stephone B. Allen
*Assistant Examiner*—Suezu Ellis
(74) *Attorney, Agent, or Firm*—Davidson, Davidson & Kappel, LLC

(57) ABSTRACT

According to one exemplary embodiment of the present invention, a method for sensing the position of an edge of a stock being feed to a printing press is provided. The method includes the steps of providing a light source, utilizing the light source to illuminate with planar radiation a preselected area of the stock, and a preselected area adjacent to the stock, and further providing a retro-reflecting surface on at least a portion of the preselected area adjacent to the stock illuminated by the light source. According to a feature of the present invention, a measuring device is provided and utilized to measure radiation reflected by the retro-reflecting surface.

18 Claims, 2 Drawing Sheets

FOREIGN PATENT DOCUMENTS

| | | |
|---|---|---|
| DE | 19653312 | 4/1998 |
| DE | 10136870 | 2/2003 |
| DE | 10136871 | 2/2003 |
| EP | 1279919 | 1/2003 |
| WO | 9512809 | 5/1995 |

OTHER PUBLICATIONS

Ryan Burns, Richard Homsey, CMOS Image Sensor With Cumulative Cross Section Readout, www.cs.yorku.ca/~visor/pdf/CCDAIS03_CCS.pdf.

* cited by examiner

DEVICE AND METHOD FOR SENSING THE POSITION OF AN EDGE OF A PRODUCT

This application claims priority to German Patent Application 103 25 377.7, filed Jun. 5, 2003, which is hereby incorporated by reference herein.

BACKGROUND

The present invention is directed a device for sensing the position of an edge of a product, as well as to a method for sensing the position of an edge of a product.

During the process of printing sheets, in particular in a sheet-fed offset press, the sheets are supplied to the press from a sheet stack. When a single sheet is fed to the printing press, known methods heretofore provide for the sheet to be laterally aligned at the feeder along a guide edge. However, it is also possible for the sheet to be laterally aligned by actuator-driven displacement of the front sheet edge on the cylinder, thus during conveyance of the sheet. Such actuator-driven displacement is known, for example, from the German Application DE 196 18 030 and related U.S. Pat. No. 6,264,196, which is hereby incorporated by reference herein. In response to the actuator-driven displacement, the sheet is guided to a defined setpoint position, the actual position of the sheet being detected by sensors.

To ensure exact alignment of the sheet, the actual position of the sheet edge must be precisely determined. A device for sensing and controlling the edge position of a continuous web is already known from the German Application DE 36 37 874. When working with this device, a web is irradiated by an illuminating device that extends over a planar area. The light beams striking the web are reflected from there in accordance with the laws of reflection and fed to an electro-optical image sensor. The electro-optical image sensor scans a strip on the web by sequential lines, the strip also encompassing a partial area situated outside of the web. In this way, the width of the area situated outside of the web can be determined and, from this, in turn, the position of the web. However, this method can only be applied when the material web used is a material web that is sufficiently reflective in accordance with the laws of reflection. This is particularly not the case when working with transparent films.

From the German Application DE 101 36 871, a device is known for sensing the position of an edge of a sheet that is fed to a printing press. In this case, an opto-electronic measuring device is used, which is oriented orthogonally to the conveyance direction of the sheet.

The measuring device is mounted above the feedboard and has reflecting arrays which are able to detect a reflected beam. To enable problematic sheets to be detected, in particular transparent or high-gloss materials, the surface of the feedboard is additionally provided with contrast-enhancing means. To this end, the feedboard is specially finished in one partial area, in particular highly polished, chromium-plated, or provided with a reflective layer. However, the drawback when working with this device is that it is no longer possible to distinguish the materials themselves from the contrast-enhancing layer when the sheets to be measured have surface properties which correspond or nearly match those of a highly polished or chromed surface.

SUMMARY OF THE INVENTION

An object of the present invention is to provide a device and a method for sensing the position of an edge of a stock material, such as, for example, printing substrate, which are further optimized with regard to the measurability of various types of stock.

In one preferred embodiment of the present invention, a device for sensing a position of an edge of a stock being feed to a printing press is provided. The device comprises a light source arranged to illuminate a preselected area of the stock, and a preselected area adjacent to the stock, and a measuring device for recording reflected radiation caused by reflection of radiation of the illumination of the light source. In accordance with a feature of the present invention, at least a portion of the preselected area adjacent to the stock that is being illuminated by the light source, comprises a retro-reflecting surface. The light source includes a planar illumination source.

In another preferred embodiment of the present invention, a method for sensing the position of an edge of a stock being feed to a printing press is provided. The method includes the steps of providing a light source, utilizing the light source to illuminate with planar radiation a preselected area of the stock, and a preselected area adjacent to the stock, and further providing a retro-reflecting surface on at least a portion of the preselected area adjacent to the stock illuminated by the light source. According to a feature of the present invention, a measuring device is provided and utilized to measure radiation reflected by the retro-reflecting surface.

DETAILED DESCRIPTION OF THE PREFERRED EMBODIMENTS

Figure 1:
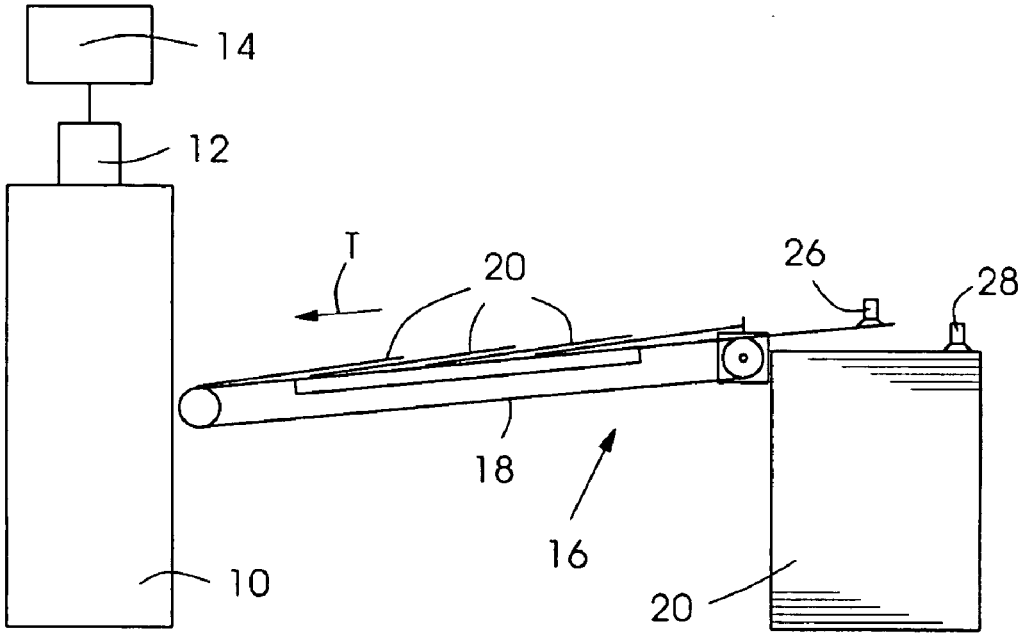
FIG. 1 is a schematic representation of a printing press arrangement having a feeder for feeding sheets of stock to the printing press.

Referring now to the drawings, and initially to FIG. 1, there is illustrated a schematic representation of a printing press arrangement having a feeder for feeding sheets of stock to the printing press. FIG. 1 depicts a print unit 10 having a drive unit 12 assigned thereto which is controlled or regulated by a control electronics 14 associated with the print unit. With the aid of a feeder 16, which may include a suction band 18, for example, stock such as paper sheets 20 are fed to the print unit 10 in a conveyance direction T. The paper sheets 20 are supplied from a paper stack with the aid of a lifting suction device 28 and a forwarding suction device 26, in a paced feeding sequence to the feeder 16. In the feeder 16, a feed board 22 (see FIG. 2) is provided, on which a retro-reflecting surface 30 may be applied in accordance with the present invention.

Thus, the device according to the present invention is distinguished in that a retro-reflecting surface area is used to sense the position of an edge of a stock. This retro-reflecting area is provided at a location where the stock 20 is fed to the printing press. By illuminating both the stock, as well as the adjacent retro-reflecting surface area, the edge of the stock may be ascertained even in cases where the stock itself reflects specularly. This is because the retro-reflecting surface area reflects the incident light back in the direction of the incident radiation. If a sensor is provided in this direction for detecting the retro reflected radiation, then the radiation that is reflected outside of the stock into the retro-reflecting sensor system, may be uniquely detected. The stock itself, on the other hand, does not reflect any radiation into the sensor, since it either scatters the radiation or reflects the incident radiation specularly, in a different solid angle, in accordance with the laws of optics.

Figure 2:
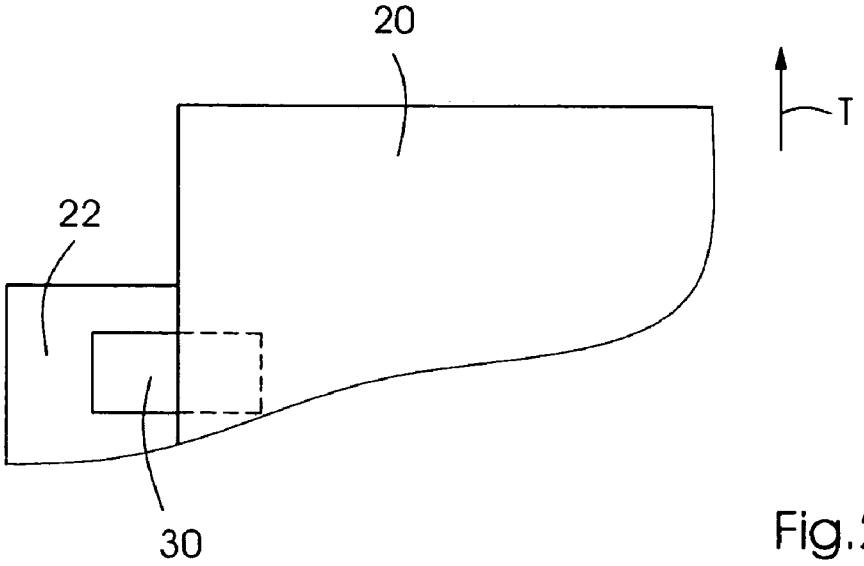
FIG. 2 is a schematic representation of a plan view of a portion of the feeder of FIG. 1.

As shown schematically in the plan view of FIG. 2, the sheet 20, which is to be fed to the print unit 10 in direction T, is present on feed board 22. At a suitable location on the feed board 22, a retro-reflecting surface 30 is provided in such a way that a sheet 20 conveyed in the direction T only partially covers the retro-reflecting surface 30. This partial covering may be ensured, for example, by providing the entire feed board 22 with a retro-reflecting surface. Of course, as shown in FIG. 2, it is also possible to provide a partial region of the feed board 22 with the retro-reflecting surface 30.

According to a feature of the present invention, CMOS matrix elements or CCD matrices, arranged in a two-dimensional array, may be used as a stock image sensor. The imaging quality may be further improved, in particular the imaging contrast enhanced, when working with films, in that light that is linearly polarized in a suitable direction is used to illuminate the stock or sheet and the retro-reflecting area adjacent to the sheet. By using CMOS matrix elements as image sensors and with the aid of fast readout algorithms, it is possible to increase the measuring frequency. For example, the article entitled "CMOS Image Sensor with Cumulative Cross Section Readout" by Bums and Homsey (www.cs.yorku.ca/~visor/pdf/CCDAIS03_CCS.pdf) and "A 640×512 CMOS Image Sensor with Ultrawide Dynamic Range Floating-Point Pixel-Level ADC" by Yang, Gamal, Boyd and Tian (IEEE Journal of Solid-State Circuits, Vol. 34, No. 12, December 1999) describe CMOS readouts, and are hereby incorporated by reference herein. This enables a plurality of measured values to be recorded per sheet, from which an average value may then be calculated, thereby enabling error measurements to be minimized.

Figure 3:
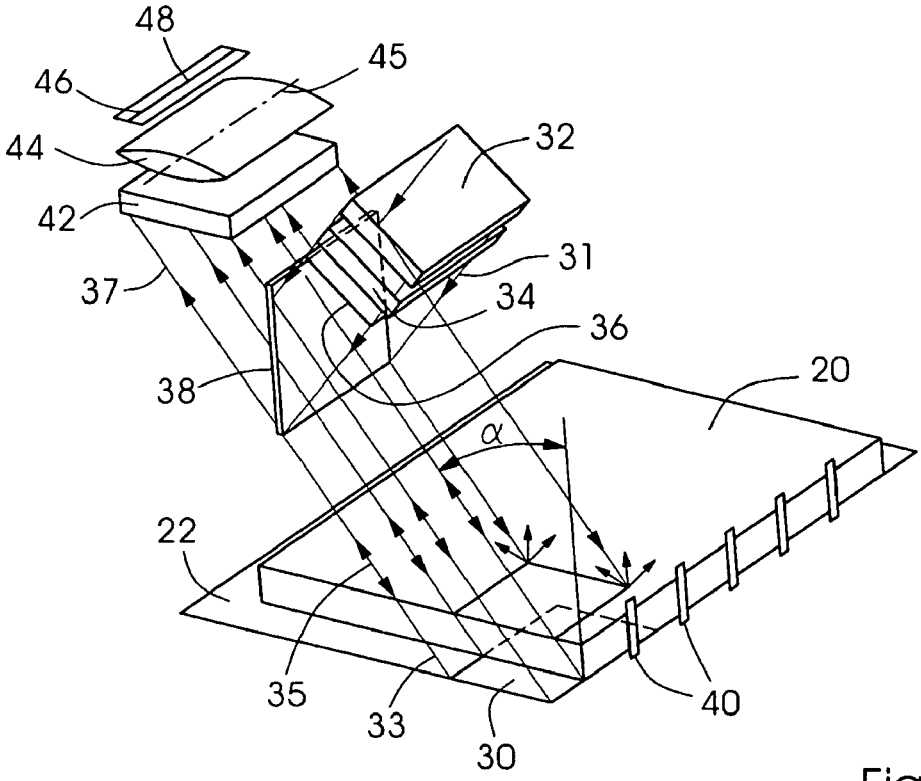
FIG. 3 is a schematic representation of a device for measuring the position of an edge of a stock being feed to a printing press, and having a CCD array according to a feature of the present invention.

Referring now to FIG. 3, there is illustrated a device for sensing the position of an edge of a sheet which is to be fed to a printing press, according to a preferred embodiment of the present invention. Via a light source 32, which is disposed downstream from an optics arrangement 34, a parallel light beam 31 is fed to a semi-reflective mirror 38. Upstream from where the light beam 31 strikes the semi-reflective mirror 38, a polarization filter 36 may also be provided for linearly polarizing the light. The illuminating device is preferably mounted in such a way that light beam 31 is oriented in parallel to the xz plane and forms an angle $\alpha$ of greater than 0° with the z-axis. In addition, light source 32 is positioned in such a way that sheet 20 is partially situated in the light path ray trajectory of the illumination. The sheet 20 is present on the a feed board 22. The retro-reflecting surface 30 is provided, in particular as a retro-reflecting film or retro-reflecting coating, at least in one partial region on the feed board 22. This retro-reflecting surface has the property of reflecting back an incident light beam 33 precisely in the direction of incidence. Consequently, light 35 reflected by the retro-reflecting surface 30 is fed again to semi-reflective mirror 38. The light beams 35 are able to partially penetrate mirror 38, depending on its transmittance. These component beams of light, at this point characterized as measuring beams 37, are fed via a lens 42 and a cylindrical lens 44 to a CCD array 46. By using the cylindrical lens 44, it is ensured that the light beams are only imaged in one direction. As a result, the measuring beams 37 striking the cylindrical lens 44 are refracted in such a way that they intersect in one line. Since the cylindrical lens 44 is positioned in such a way that cylinder axis 45 runs in parallel to the y-axis and the distance between the cylindrical lens and CCD array 46 is equal to the focal length of the cylindrical lens, the image of the rectangular illumination cross-section is formed in one line in the x-direction, i.e., on CCD array 46. It is, thus, possible to obtain an optical averaging over one defined length of the sheet edge. Using this arrangement in this way, the lateral position of a sheet 20 resting against front guides 40 may be precisely determined, the averaging being carried out over one defined area of the sheet edge, which may then be established as an image of sheet edge, designated by reference numeral 48.

Figure 4:
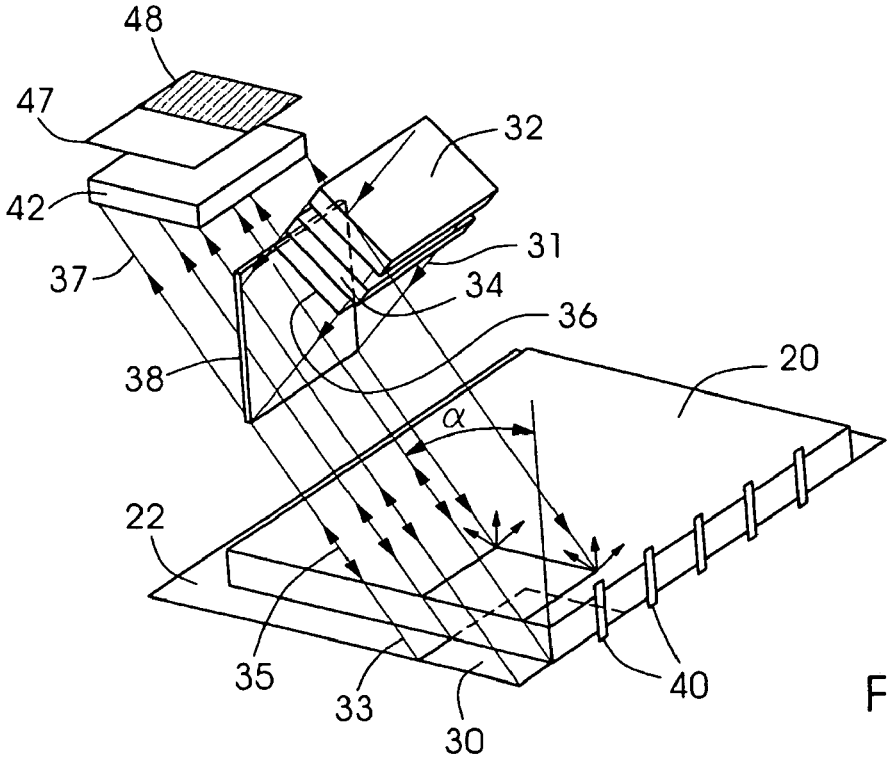
FIG. 4 is a schematic representation of a device for measuring the position of an edge of a stock being feed to a printing press, and having a CMOS matrix according to a feature of the present invention.

Another exemplary embodiment of the present invention is shown in FIG. 4. In contrast to the embodiment shown in FIG. 3, in the embodiment of FIG. 4, a CMOS matrix 47 is used as an image sensor. Using CMOS matrix 47 eliminates the need for a cylindrical lens. Light 35 reflected by the retro-reflecting surface 30 penetrates, in turn, the semi-reflective mirror 38. These measuring beams 37 are imaged via lens 42 onto a CMOS matrix 47. In this context, CMOS matrix 47 is composed of very small photosensitive elements, which are arrayed in the manner of elements of a matrix. However, in contrast to a CCD matrix, each individual photosensitive element may be optionally read out. Thus, by using this arrangement, an image of the sheet, i.e., of lateral sheet edge 48, is formed on CMOS matrix 47. By evaluating the pixels of the matrix, an averaged lateral position, i.e., a position in the y-direction of the sheet edge is calculated.

Since it is possible to read out the individual photosensitive elements of the CMOS matrix 47, the number of pixels to be read out may be decidedly reduced by using fast readout algorithms, thereby enabling the measuring frequency to be clearly increased in comparison to a CCD matrix have the same number of pixels. By using parallel light, which is oriented in parallel to the x-z plane, disadvantageous influences caused by a sheet edge that is slightly curved in the z-direction, may be kept to a minimum; the quality, and the y-position of the shadow of the sheet edge cast on the retro reflecting surface 30, being only slightly affected. Moreover, optical power losses occurring within the system are minimized by using parallel light.

In addition to the embodiments illustrated in FIGS. 3 and 4, it is also possible, instead of a CCD array or a CMOS matrix, to use a CCD matrix or a photo diode to detect the measuring beams 37. When a photo diode is used, the light, which is reflected by the retro reflecting surface 30 and has penetrated the semi reflective mirror 38, is focused via a lens at a photo diode, and the intensity of the diode's photoelectric current is measured. To determine the y-position of a lateral sheet edge, the entire sensor is moved via a guide in the y-direction, and the y-position of the light beam is continuously recorded by a position-measuring system. When the lateral sheet edge is crossed in the y-direction, the intensity of the diode's photoelectric current changes almost abruptly, so that the sheet edge is able to be determined, in turn.

In the preceding specification, the invention has been described with reference to specific exemplary embodiments and examples thereof. It will, however, be evident that various modifications and changes may be made thereto without departing from the broader spirit and scope of the invention as set forth in the claims that follow. The specification and drawings are accordingly to be regarded in an illustrative manner rather than a restrictive sense.

REFERENCE NUMERAL LIST

10 print unit
12 drive unit
14 control
16 feeder
18 suction band
20 sheet
22 feed board
24 stack
26 forwarding suction device
28 lifting suction device
30 retro reflecting surface
31 light beam
32 light source
33 incident light beam
34 optics
35 retro reflecting light beam
36 polarization filter
37 measuring beam
38 semi reflective mirror
40 front guide
42 lens
44 cylindrical lens
45 cylinder axis
46 CCD array
47 CMOS matrix
48 image of the sheet edge

What is claimed is:

1. A device for sensing a position of an edge of sheets being fed to a printing press, the device comprising:

a light source arranged to illuminate with radiation a preselected area of the sheets, and a preselected area adjacent to the sheets; and a measuring device for recording reflected radiation caused by reflection of radiation of the illumination of the light source;

at least a portion of the preselected area adjacent to the sheets that is illuminated by the light source comprising a retro-reflecting surface;

the light source including a planar illumination source.

2. The device of claim 1 wherein the measuring device is positioned in an angle of incidence ($\alpha$) of the radiation of the light source.

3. The device of claim 1 wherein the measuring device comprises a two-dimensional CMOS matrix image sensor.

4. The device of claim 1 further comprising a semi-reflective mirror, the semi-reflective mirror being arranged to transmit a portion of the illumination of the light source to the sheets and to the preselected area adjacent to the sheets.

5. The device of claim 4 wherein the semi-reflective mirror is arranged such that radiation reflected by the retro-reflecting surface of the preselected area adjacent to the sheets is transmitted through the semi-reflecting mirror and to the measuring device.

6. The device of claim 1 further comprising a polarization filter to polarize illumination from the light source prior to radiating the preselected area of the sheets and the preselected area adjacent to the sheets.

7. The device of claim 6 wherein the polarization filter is positioned intermediate the light source and the semi-reflective mirror.

8. The device of claim 1 wherein the measuring device comprises a CCD array.

9. The device of claim 1 wherein the measuring device comprises a photodiode.

10. The device of claim 8 further comprising a cylindrical lens arranged intermediate the CCD array and the retro-reflecting surface of the preselected area adjacent to the sheets.

11. The device as recited in claim 1 wherein the preselected area on the sheets is a planar area of the sheets.

12. A method for sensing the position of an edge of sheets being fed to a printing press, comprising the steps of:

providing a light source;

utilizing the light source to illuminate with planar radiation a preselected area of the sheets, and a preselected area adjacent to the sheets;

providing a retro-reflecting surface on at least a portion of the preselected area adjacent to the sheets illuminated by the light source;

providing a measuring device;

utilizing the measuring device to measure radiation reflected by the retro-reflecting surface; and utilizing a semi-reflecting mirror to transmit radiation illuminated by the light source to the preselected area of the sheets and to the preselected area adjacent to the sheets.

13. The method of claim 12 wherein the radiation reflected by the retro-reflecting surface is transmitted through the semi-reflecting mirror to the measuring device.

14. The method of claim 12 comprising the further step of utilizing a polarization filter to polarize the radiation illuminated by the light source.

15. The method of claim 12 wherein the measuring device comprises a CMOS matrix.

16. The method of claim 15 comprising the further step of utilizing the CMOS matrix to measure a plurality of values of reflected radiation per sheet.

17. The method of claim 16 comprising the further step of calculating an average value from the plurality of measured values.

18. The method as recited in claim 12 wherein the preselected area on the sheets is a planar area of the sheets.

* * * * *